US010088168B2

(12) United States Patent
Yeh et al.

(10) Patent No.: US 10,088,168 B2
(45) Date of Patent: Oct. 2, 2018

(54) GAS-BURNING APPLIANCE AND GAS FIREPLACE

(71) Applicant: BAHUTONG ENTERPRISE LIMITED COMPANY, Taichung (TW)

(72) Inventors: Yen-Jen Yeh, Taichung (TW); Kuan-Chou Lin, Taichung (TW); Wei-Long Chen, Taichung (TW)

(73) Assignee: BAHUTONG ENTERPRISE LIMITED COMPANY, Taichung (TW)

( * ) Notice: Subject to any disclaimer, the term of this patent is extended or adjusted under 35 U.S.C. 154(b) by 313 days.

(21) Appl. No.: 15/204,840

(22) Filed: Jul. 7, 2016

(65) Prior Publication Data

US 2017/0010001 A1 Jan. 12, 2017

(30) Foreign Application Priority Data

Jul. 9, 2015 (TW) ..... 104122333 A

(51) Int. Cl.
*F23L 9/00* (2006.01)
*F24C 3/00* (2006.01)
(Continued)

(52) U.S. Cl.
CPC ..... *F24C 3/004* (2013.01); *F23C 7/008* (2013.01); *F23D 14/105* (2013.01); *F23L 9/00* (2013.01);
(Continued)

(58) Field of Classification Search
CPC ..... F23L 7/00; F23C 7/00; F23C 3/00; F23D 14/70
(Continued)

(56) References Cited

U.S. PATENT DOCUMENTS 2,439,038 A * 4/1948 Cartter ..... F24C 3/042 126/91 A
3,805,763 A * 4/1974 Cowan ..... F23D 14/14 126/92 B
(Continued)

FOREIGN PATENT DOCUMENTS

CN 201909382 U 7/2011
CN 102401375 A 4/2012
(Continued)

OTHER PUBLICATIONS

European Search and Examination Report for EP3115696, Total of 5 pages.
(Continued)

*Primary Examiner* — Gregory Huson
*Assistant Examiner* — Nikhil Mashruwala
(74) *Attorney, Agent, or Firm* — Lynette Wylie; Apex Juris, Pllc.

(57) ABSTRACT

A gas-burning appliance includes a combustor and a flow guide device engaged with the combustor. The combustor has a gas outlet. The flow guide device includes a separator and two stop plates. The separator has an opening. Each of the stop plates is located at the opening, and a top edge thereof is higher than a top surface of the separator. The combustor is located below the separator with the gas outlet corresponding to a space between the stop plates. The flow guide device has at least one first air inlet, which is located below the separator, and communicates with the space between the stop plates. A gas fireplace includes a firebox, a translucent shield, and the gas-burning appliance. A separator divides the firebox into an air chamber, which receives the combustor, and a combustion chamber. Whereby, the visibility of flame and the combustion efficiency could be improved.

23 Claims, 12 Drawing Sheets

(51) Int. Cl.

| | |
|---|---|
| ***F23M 9/06*** | (2006.01) |
| ***F23D 14/10*** | (2006.01) |
| ***F24C 15/00*** | (2006.01) |
| *F23C 7/00* | (2006.01) |

(52) U.S. Cl.
CPC ..... *F23M 9/06* (2013.01); *F24C 3/006* (2013.01); *F24C 15/002* (2013.01); *F23C 7/00* (2013.01); *F23D 2203/002* (2013.01); *F23D 2206/0094* (2013.01)

(58) Field of Classification Search
USPC ..... 126/512, 92 R; 431/125
See application file for complete search history.

(56) References Cited

U.S. PATENT DOCUMENTS

| | | | | |
|---|---|---|---|---|
| 4,368,722 | A * | 1/1983 | Lynch | F24B 1/02 126/242 |
| 4,793,332 | A | 12/1988 | Klein | |
| 5,016,609 | A | 5/1991 | Shimek | |
| 5,452,708 | A | 9/1995 | Shimek | |
| 5,701,882 | A | 12/1997 | Champion | |
| 5,947,113 | A | 9/1999 | Beal et al. | |
| 6,432,926 | B1 | 8/2002 | Howley et al. | |
| 6,578,570 | B2 * | 6/2003 | Fogliani | F23D 14/105 126/512 |
| 8,166,964 | B2 * | 5/2012 | Longueville | A01K 31/19 126/116 B |
| 2002/0056447 | A1 | 5/2002 | Fogliani | |

FOREIGN PATENT DOCUMENTS

| | | | |
|---|---|---|---|
| CN | 103868063 | A | 6/2014 |
| CN | 104696961 | A | 6/2015 |
| EP | 1000302 | A2 | 5/2000 |
| EP | 3115696 | A2 | 1/2017 |
| TW | 201522864 | A | 6/2015 |

OTHER PUBLICATIONS

Amendment for EP3115696, Total of 12 pages.
Examination Report for TW104122333, dated Aug. 16, 2016, Total of 4 pages.
Search Report for TW104122333, dated Aug. 12, 2016, Total of 1 page.
English Abstract for CN102401375 (A), Total of 1 page.
English Abstract for CN103868063 (A), Total of 1 page.
English Abstract for CN104696961 (A), Total of 1 page.
English Abstract for CN201909382 (U), Total of 1 page.
English Abstract for TW201522864 (A), Total of 1 page.
Chinese Office Action for CN 201510417558.4, dated Mar. 21, 2018, Total of 10 pages.
European Search Report for EP16178552, dated Nov. 22, 2016, Total of 11 pages.

* cited by examiner

GAS-BURNING APPLIANCE AND GAS FIREPLACE

The current application claims a foreign priority to application number 104122333 filed on Jul. 9, 2015 in Taiwan.

BACKGROUND OF THE INVENTION

1. Technical Field

The present invention relates generally to burning gas, and more particular to a gas-burning appliance, which has high performance and decorative flames, and a gas fireplace.

2. Description of Related Art

A conventional direct-vented gas fireplace intakes and exhausts air in a naturally balanced way, with the exhaust port and the intake port horizontally or vertically connected to the combustion chamber, and communicating with outside. The indoor air is completely isolated from the combustion chamber, which makes the direct-vented gas fireplace the safest fireplace for now. Since the exhaust port and the intake port both communicate with outside, the exhaust pipe and the intake pipe are typically designed in a pipe-in-pipe way for easier installation. In other words, the vent line has an outer intake pipe surrounding a smaller coaxial inner exhaust pipe. The outer pipe also communicates with the intake passage located on the rear side of the furnace. The intake passage communicates with outside, and is adapted to intake fresh air into the combustion chamber through one or multiple intake ports. The inner pipe communicating with the combustion chamber is adapted to exhaust the high-temperature waste air generated by combusting out of the firebox. The combustor is provided in the combustion chamber in the firebox. With the heat generated by the combustor while combusting, the air in the combustion chamber would be heated and expanded, which makes the air go up and exit the combustion chamber through the exhaust pipe due to the stack effect. Meanwhile, the enclosed combustion chamber would have negative pressure inside, which sucks the outside fresh air into the combustion chamber to provide oxygen necessary for continuous combustion. In order to make the gas fireplace show nice flaming visual effect and provide heat radiation, a transparent glass cover would be provided at the front side of the firebox, so that a user could see and feel the light and heat of the burning flame inside the firebox through the glass cover. Except the front side which is provided with the glass cover, an outer casing is provided around the firebox by a certain distance to separate the high temperature of the firebox from the building, wherein the outer casing could be located near an outer wall of the building, which reduces the space required for installation. The space between the high-temperature firebox and the outer casing could exchange heat with the indoor air, while the space between the bottom side of the firebox and the outer casing could be used to receive a control valve and a control module, and sometimes even a fan is received therein to enhance convection, which facilitates heat exchange between the firebox and the indoor air. In this way, the heating efficiency could be improved, and the indoor temperature could be increased more quickly. The structure of the fireplace mentioned herein can be seen in the U.S. Pat. No. 4,793,332, titled "DIRECTED-VENTED GAS FIREPLACE."

However, a good working direct-vented gas fireplace must meet several design requirements and regulations, including: (1) High performance: Since the intake and exhaust ports are both provided outdoors, the efficiency of heat usage has to be improved to comply with relevant laws and regulations. If either the exhaust temperature or the flow of the directed-vented gas fireplace gets too high, the performance of the fireplace would be decreased. (2) Nearly complete combustion: Though complete combustion is impossible in reality, the more it gets near complete combustion, the less carbon monoxide, hazardous material, and black smoke would be exhausted. Generally, the degree of complete combustion is not measured merely based on the absolute value of generated carbon monoxide, but is measured relative to the scale of combustion, wherein the scale of combustion could be represented by the amount of carbon dioxide. Therefore, the cleanness of combustion is usually evaluated by the relative ratio of CO and CO2. If the ratio of CO and CO2 is less than 0.004, the combustion is usually considered complete. The less this ratio is, the less amount of black smoke is generated. (3) Types and colors of flame: A fireplace has to mimic the visual effect of burning woods, which has mostly yellow-orange flame, to satisfy the aesthetic requirement of decorative flame. Colorless or blue flame could not meet the visual requirement of decorative flame. (4) Compatible with all kinds of fuel: Consumer fireplaces may be installed in many different regions, and therefore, one single model of fireplace usually has to be both compatible with natural gas (NG) and liquefied petroleum gas (LPG), and has to operate properly no matter it is horizontal or vertical direct-vented, or even in other conditions of actual use. Furthermore, fuel in each region may be somewhat different. Therefore, a fireplace has to not only meet the above requirements, but also be compatible with fuel of different compositions. (5) Compatible with large scale of combustion: To further improve the compatibility, one single model of fireplace must be compatible with large scale of combustion, and also meet the above requirements.

However, the above requirements tend to conflict with each other. For example, while lowering the exhaust temperature and flow to improve the thermal efficiency, the amount of intake air would be insufficient, leading to incomplete combustion and generating excessive carbon monoxide and black smoke. On the other hand, if the combustion is nearly complete, the flame would be colorless or blue, which fails to show the yellow-orange color visually required for decorative flame. Furthermore, it is not easy to have one single model of fireplace compatible with natural gas and liquefied petroleum gas of different components in different regions at the same time. The natures of natural gas and liquefied petroleum gas are inherently different. For example, natural gas requires less air supply than liquefied petroleum gas does. So it is possible that one fireplace combusts well with natural gas, but combusts incompletely with liquefied petroleum gas.

It's hard to solve the above problems at once, which usually takes more than one single means. This is because that, in the combustion chamber of a fireplace, the waste gas generated by combusting would form high-temperature airflow in the firebox, and flows toward the exhaust port at the top of the firebox. Since the cross-sectional area of the exhaust port is much less than that of the upper part of the combustion chamber, only small part of the high temperature airflow could successfully pass therethrough, while most of the uprising heated gas would be stopped by the wall of the top of the firebox, and turn downward to form a circulation. As a result, heat energy would be accumulated in the firebox, and then transferred into the room through the heat exchange ongoing outside the firebox. The amount of heat energy accumulated in the firebox could affect the efficiency of using energy. If the high-temperature gas is exhausted out of the firebox too quickly, the efficiency would be reduced; on the contrary, if it is exhausted too slowly, the outside air would be hindered from flowing into the firebox, which is not conducive to complete combustion.

In addition, while the outside air is guided into the firebox through the intake port, if the gas supply port of the combustor is far from the flame, the inflowing air and the high-temperature airflow formed by the waste gas of combustion tends to interfere with and blend into each other to create turbulence. Such condition would not only affect the exhaust of waste gas of combustion, but also lower the oxygen concentration in the air around the burning flame. Therefore, the supply of the amount of oxygen required for complete combustion would not be effectively controlled. Especially when the scale of combustion is expanded, the high temperature would further enhance the convection in the combustion chamber, which mixes more inflowing air into the waste gas of combustion, and more likely leads to incomplete combustion.

Prior art such as U.S. Pat. No. 4,793,332, titled "DIRECTED-VENTED GAS FIREPLACE", discloses a continuous pusher gas fireplace with high performance, which exhausts small amount of carbon monoxide (CO) and nitride (NOx), and lowers the exhaust temperature and exhaust speed to improve the thermal efficiency by optimizing the air/fuel ratio.

U.S. Pat. No. 5,016,609, titled "DIRECT VENTED MULTI GLASS SIDE FIREPLACE", discloses a high-performance continuous pusher gas fireplace which is further provided with glass on lateral sides. Said gas fireplace increases the flow of exhaust and intake air through a flow guide means. In addition, a heat exchange structure with extended surface area is provided at the top of the firebox to improve the thermal efficiency.

U.S. Pat. No. 5,452,708, titled "UNIVERSAL HORIZONTAL-VERTICAL (H-V) DIRECT-VENTED GAS HEATING UNIT", discloses a high-performance continuous pusher gas fireplace compatible with horizontal and vertical air communication. In order to control the air/fuel ratio, the passage and the flow guide plate are arranged to make multiple intake ports located together and below the combustion tube, whereby the oxygen concentration on the combustion surface could be increased. A stop plate is further provided in front of the exhaust port at the top of the firebox to control the trace of exhausting the high-temperature waste gas.

U.S. Pat. No. 5,947,113, titled "DIRECT VENT GAS APPLIANCE WITH VERTICAL AND HORIZONTAL VENTING", discloses a high-performance continuous pusher gas fireplace compatible with horizontal and vertical air communication. The passage does not directly communicate with the high-temperature firebox. A stop plate is further provided in front of the exhaust port at the top of the firebox to control the flow trace of the high-temperature waste gas.

U.S. Pat. No. 6,432,926, titled "DIRECT VENT FIREPLACE WITH BAFFLE, DIRECTIONAL EXHAUST AND VENT AIR COLUMN", discloses a continuous pusher gas fireplace, which has a stop flow plate provided in front of the exhaust port of the firebox to increase the area to be heated, and has an airway to guide air to the bottom of the firebox. The thermal efficiency could be improved due to the heat exchange on the surface of the firebox is hindered.

Though the designs disclosed in these patents are different at adding different types of separators and flow guide plates in the combustion chamber, and at arranging the intake passage differently, they still have something in common. One is that either the traces of exhausting the high-temperature waste gas are all arranged in a way that the flow trace of the high-temperature waste gas becomes longer, or the areas for heat exchange at the high-temperature portion at the top of the combustion chamber are increased to improve heat exchange efficiency, and to evenly decrease flow speed, which prevents the high-temperature waste gas from causing excessive disturbance and circulation in the combustion chamber, and prevents the intake air from being excessively mixed into the waste gas of combustion. Another common aspect is that the intake ports of the combustion chamber are drawn near and are distributed roughly at the bottom of the burning appliance to increase the oxygen concentration in the flow field near the flame of the burning appliance, which facilitates complete combustion. Some of the disclosures even reduce the area of the intake passage which directly contact with the high-temperature firebox, which lowers the temperature of the intake air, and increases the efficiency of drawing in the intake air.

Though the current technology and designs could provide a certain benefit, it is not common to see a product integrating the forms of flame with the burning appliance, and the flow field in the combustion chamber and the amount of intake air are less seen to be precisely controlled. In light of this, while trying to comply with relevant laws and regulations, the use of a product might be limited.

As shown in FIG. 1 and FIG. 2, a conventional gas-burning appliance 1 is a long tube 10, which is linear or curved, and has a plurality of exhaust orifices 102 provided along a major axis thereof. An end of the tube 10 is adapted to accept gas to flow therein to perform a primary gas-mixing. After the primary gas-mixing, the gas would flow out through the exhaust orifices 102. While burning gas, the conventional gas-burning appliance 1 fails to effectively control the secondary air required for combustion. Therefore, the height of the flame generated from the exhaust orifices 102 could be effectively increased. Even if the amount of gas supply is raised to try to increase the height and the visibility of the flame, the outcome would not be apparent.

This is because that, by providing more gas supply to the exhaust orifices 102 to try to increase the height of the flame, the turbulence in the flow field near the exhaust orifices 102 would worsen, for the flow speed and heat energy are increased. Turbulence is a kind of flowing state of fluid. At low velocities, the fluid tends to flow without lateral mixing, and adjacent layers slide past one another, wherein the moving direction of molecules is the same as the direction of flow. Such phenomenon is called laminar flow, wherein no cross-currents perpendicular to the direction of flow. If the velocity is increased to a certain extent, molecules will move perpendicular to the direction of flow, creating many irregular tiny eddies in the flow field. Such phenomenon is called turbulence, which facilitates heat transfer or adequate mixture.

Laminar flow is helpful to generate wide yellow-orange flame which is more visible, and turbulence is helpful to mix the flammable gas and the nearby air during combustion. However, combustion requires certain conditions and reaction speed. Over-mixing combustion-supporting air tends to generate colorless or blue flame, to produce nitride (NOx), or to cause excessive flow speed in some parts, which is not conducive to complete combustion. These conditions all lower the visibility of the flame, and make the flame flicker discontinuously. Therefore, increasing the amount of gas supply would not effectively enhance the visibility of the flame, nor effectively enhance the visibility or scale of the wide yellow-orange flame.

In a gas fireplace, the turbulence generated in the enclosed firebox would enhance the disturbance and convection of airflow. Especially when the scale of the flame is expanded, the air with high oxygen concentration drawn from outside tends to be interfered by the turbulence. In such condition, it's hard to control the right combustion conditions. Therefore, the conventional gas-burning appliance 1 might not be perfect, and still has room for improvement.

BRIEF SUMMARY OF THE INVENTION

In view of the above, the primary objective of the present invention is to provide a gas-burning appliance and a gas fireplace, which increases the visibility and height of visible yellow-orange flame without increasing the amount of gas supply.

The present invention provides a gas-burning appliance, which includes a combustor and a flow guide device. The combustor is adapted to burn gas, wherein the combustor is long, and has a gas outlet provided in a major axial direction thereof. The flow guide device is engaged with the combustor, wherein the flow guide device includes a laterally provided separator and two stop plates facing each other. The separator has a long opening. Each of the stop plates is long, and is located at the opening, wherein a top edge of each of the stop plates is higher than a top surface of the separator. The combustor is located below the separator, with the gas outlet corresponding to a space between the stop plates. The flow guide device further has at least one first air inlet located below the separator, wherein the at least one first air inlet communicates with the space between the stop plates.

The present invention further provides a fireplace, which includes a firebox, a translucent shield, a flow guide device, and a combustor. The firebox includes an intake port, an exhaust port, and a window, wherein the window is located between the intake port and the exhaust port. The translucent shield covers the window. The flow guide device is provided in the firebox, wherein the flow guide device comprises a separator and two stop plates facing each other. The separator divides the firebox into an air chamber above and a combustion chamber below, wherein the air chamber communicates with the intake port, while the combustion chamber corresponds to the translucent shield, and communicates with the exhaust port. The separator has a long opening communicating the air chamber and the combustion chamber. Each of the stop plates is long, and is located at the opening, wherein a top edge of each of the stop plates is higher than a top surface of the separator. The flow guide device further has at least one first air inlet located below the separator, wherein the at least one first air inlet communicates with the opening. The combustor is adapted to burn gas, wherein the combustor is long, and has a gas outlet provided in a major axial direction thereof. The combustor is located below the separator. The gas outlet corresponds to a space between the stop plates.

With the flow guide device, the gas-burning appliance could guide the airflow upward between the stop plate, which increases the visibility of the visible yellow-orange flame and the height of the flame without increasing the amount of gas supply. The gas fireplace applied with the gas-burning appliance has a separator in the firebox thereof, wherein the separator defines the air chamber and the combustion chamber, whereby the fresh air below the separator could be directly guided to the combustion space between the stop plates without being mixed with the high-temperature waste gas. By gathering and efficiently guiding the air with high oxygen concentration to the combustion space, the combustion efficiency could be greatly improved.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
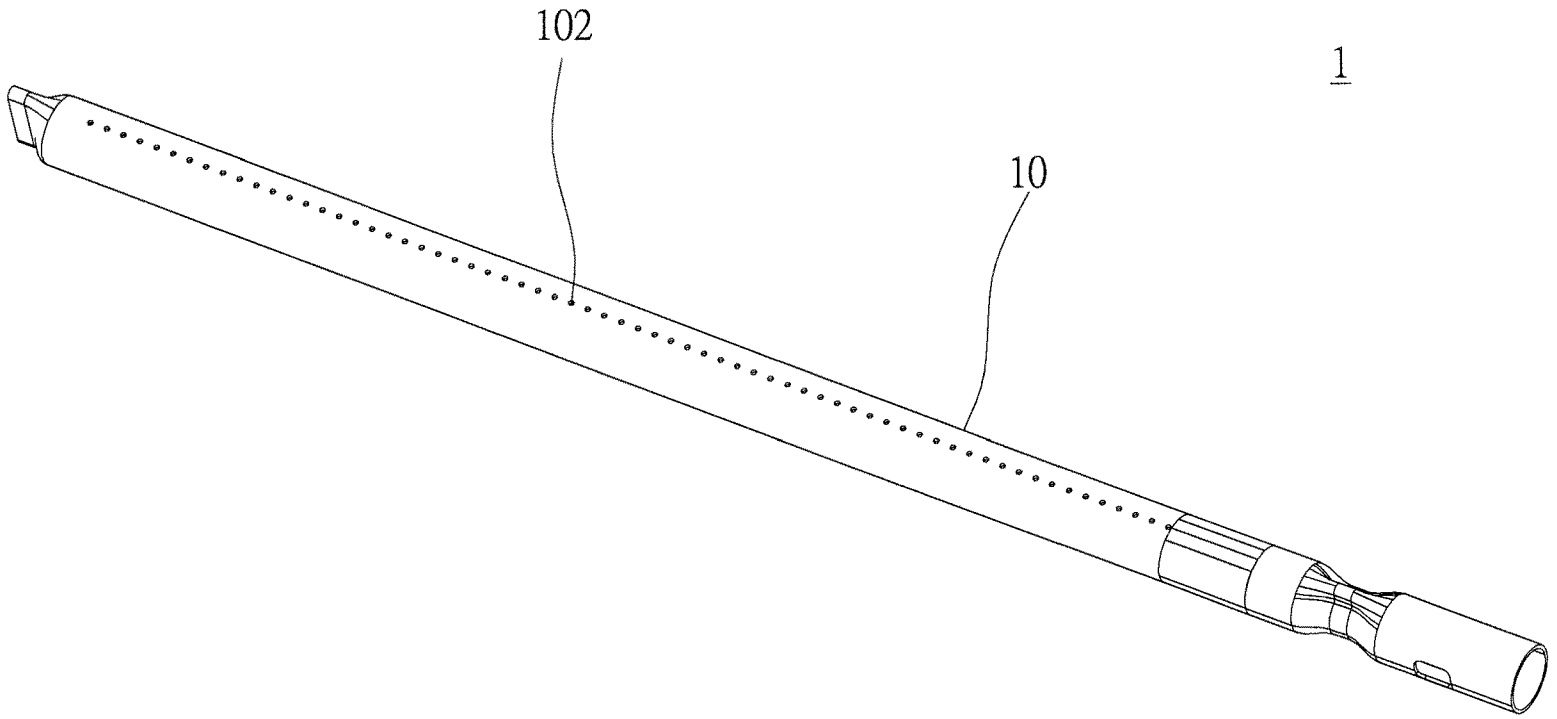
FIG. 1 (PRIOR ART)
FIG. 1 is a perspective view of a conventional gas-burning appliance.
Figure 2:
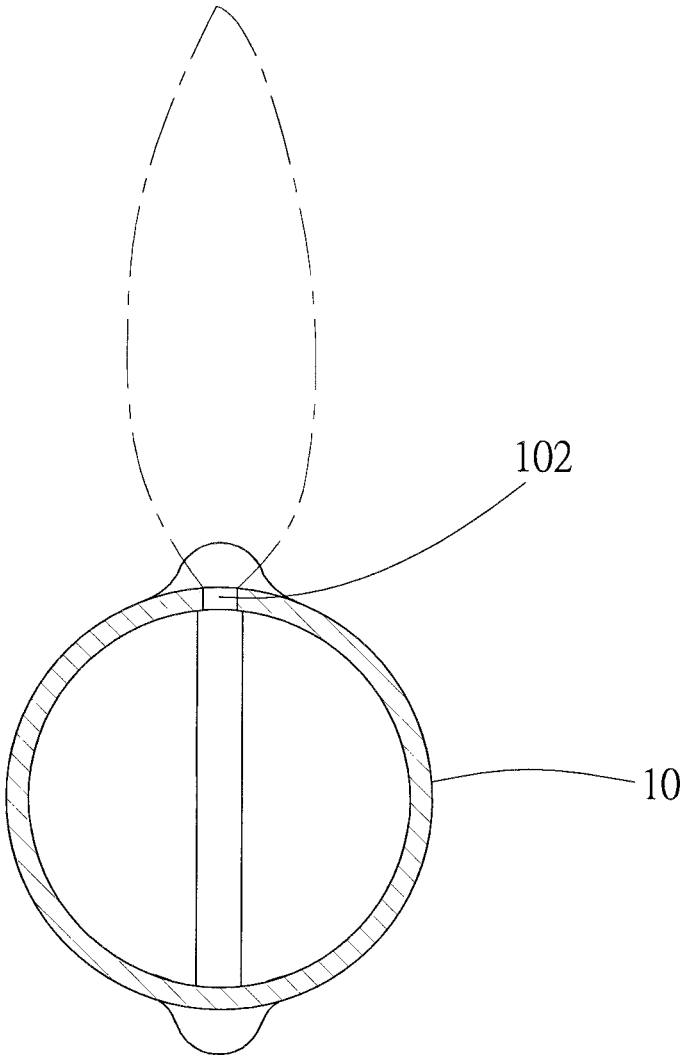
FIG. 2 (PRIOR ART)
FIG. 2 is a sectional view of the conventional gas-burning appliance.
Figure 3:
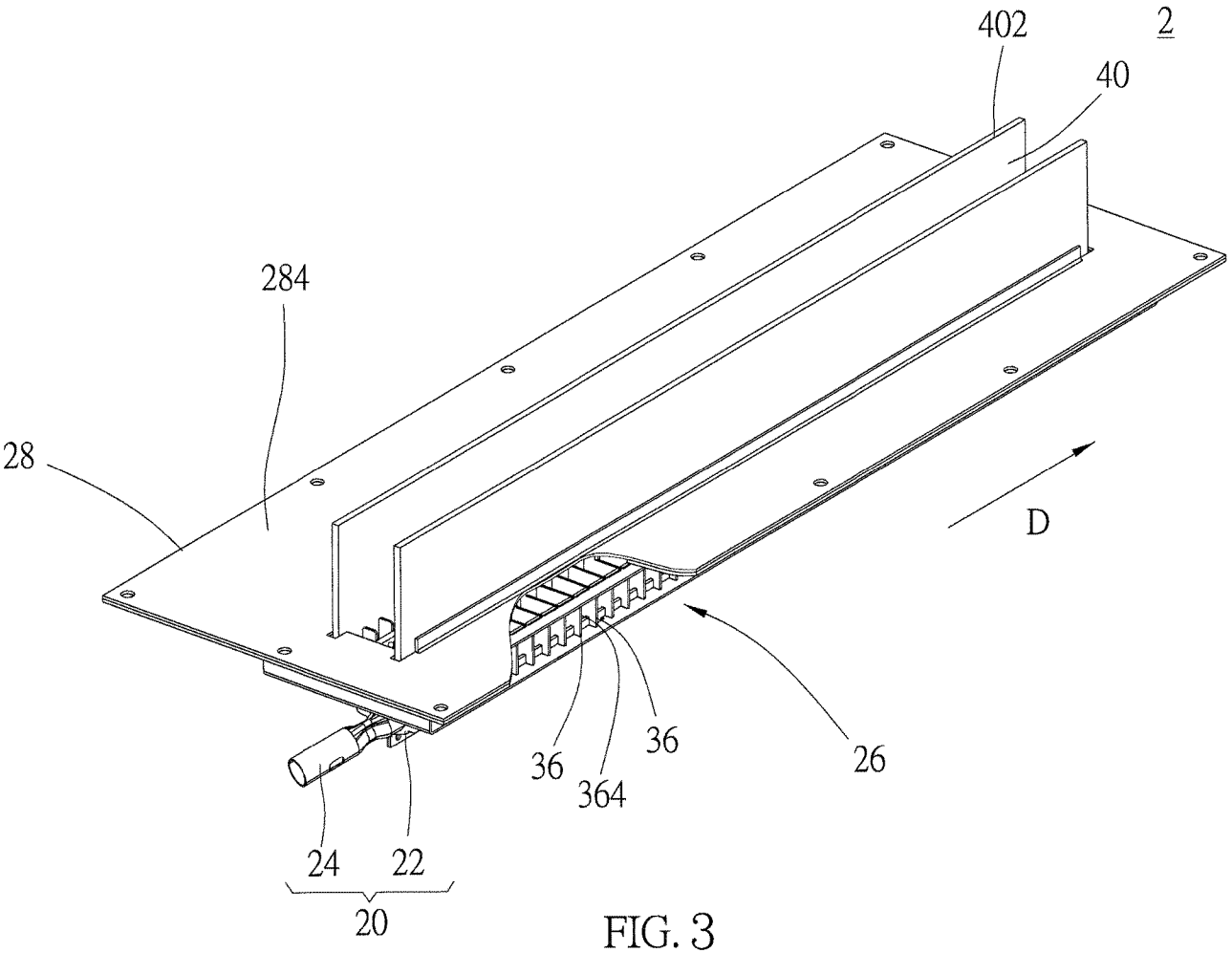
FIG. 3 is a perspective view of the gas-burning appliance of an embodiment of the present invention.
Figure 4:
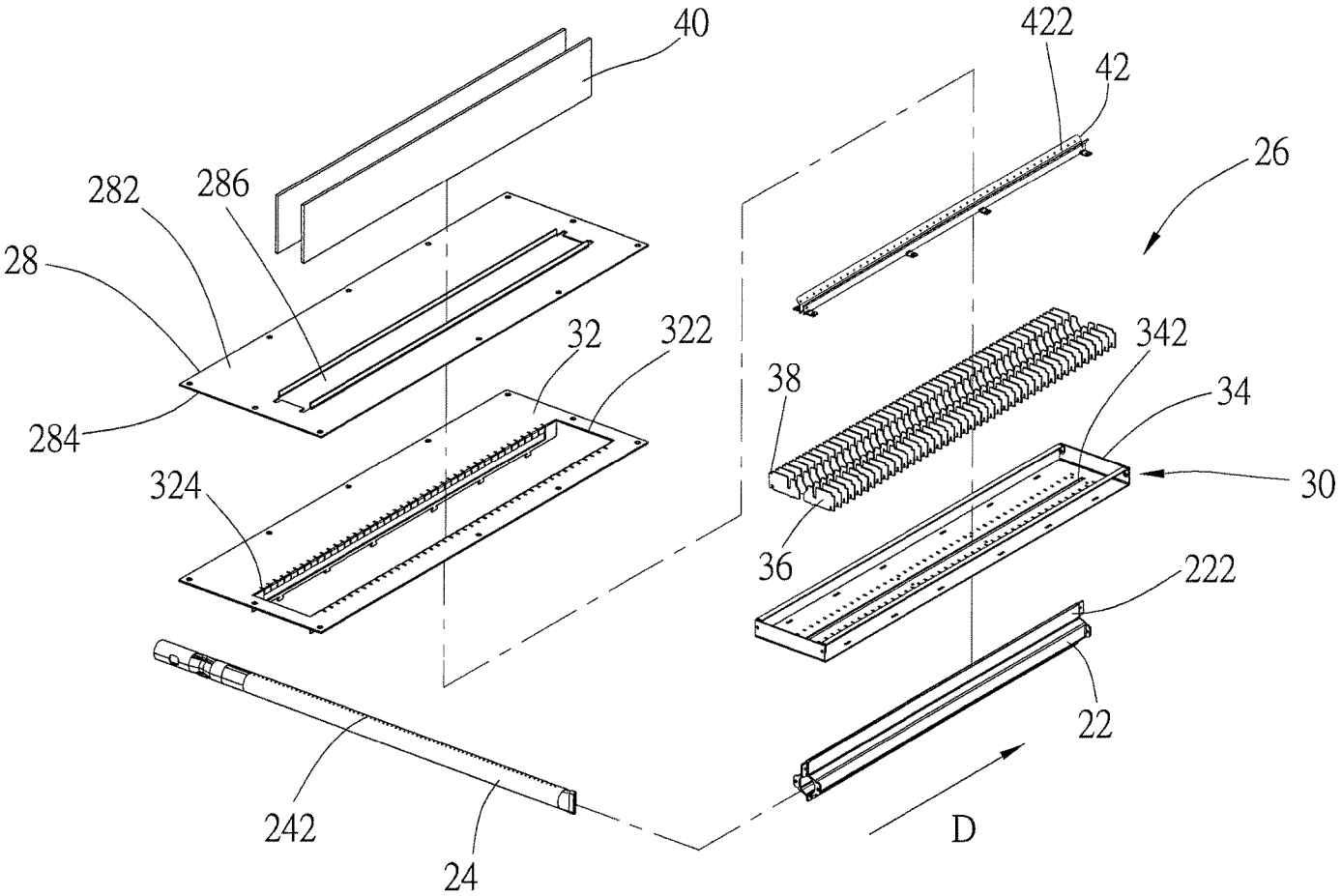
FIG. 4 is an exploded view of the gas-burning appliance of the embodiment of the present invention.
Figure 5:
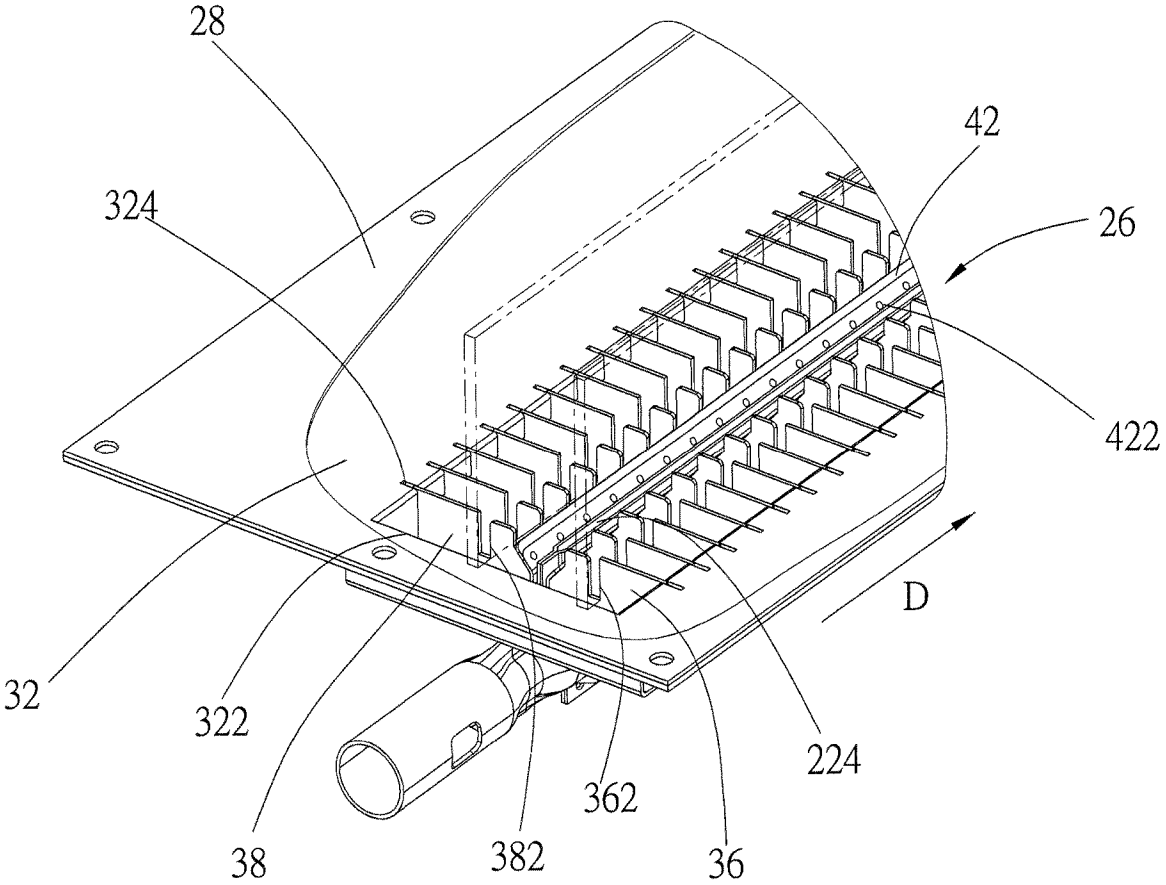
FIG. 5 is an enlarged partial view of the gas-burning appliance of the embodiment of the present invention.

As shown in FIG. 3 to FIG. 6, a gas-burning appliance 2 of the embodiment of the present invention includes a combustor 20 and a flow guide device 26.

The combustor 20 is long, including an outer casing 22 and a tube 24, wherein the outer casing 22 is formed by assembling two long half casings, each of which has a protruding plate 222. The protruding plates 222 are separated from each other by a distance, forming an upward gas outlet 224 between top edges of the protruding plates 222, wherein the gas outlet 224 extends in a major axial direction of the outer casing 22. The tube 24 is disposed in the outer casing 22, and is covered by both of the half casings. An end of the tube 24 is adapted to accept gas to flow in. The tube 24 has a plurality of exhaust orifices 242, which are arranged in a major axial direction of the tube 24 to correspond the gas outlet 224. The gas flowing into the tube 24 would flow upward through the exhaust orifices 242 and then the gas outlet 224.

The flow guide device 26 includes a laterally provided separator 28, a holder 30, a plurality of first separating plates 36, a plurality of second separating plates 38, and two stop plates 40. The separator 28 has a top surface 282, a bottom surface 284, and an opening 286 going through the upper and the bottom surfaces 282, 284, wherein the opening 286 is long, with its major axial direction parallel to a major axial direction of the combustor 20. The holder 30 is provided on the bottom surface 284 of the separator 28, wherein the holder 30 includes a fixing plate 32 and a base 34. The fixing plate 32 has an opening 322 going through a top and a bottom side thereof, wherein the opening 322 has a plurality of fixing slots 324 provided on two opposite peripheral edges thereof. Furthermore, the fixing slots 324 on the same edge are separately arranged in a reference axial direction D, which is parallel to the major axial direction of the combustor 20. The base 34 is located under the fixing plate 32, and has an elongated opening 342, which extends in the reference axial direction D. The protruding plates 222 of the combustor 20 are engaged with the base 34 by entering the base 34 through the elongated opening 342 from below.

The first and the second separating plates 36, 38 are received in the base 34. A lateral edge of each of the first separating plates 36 is inserted into one of the fixing slots 324 on one of the peripheral edges of the opening 322, so that the first separating plates 36 are separately arranged in the reference axial direction D, and are located on a side of the gas outlet 224 of the combustor 20. Similarly, a lateral edge of each of the second separating plates 38 is inserted into one of the fixing slots 324 on the other peripheral edge of the opening 322, so that the second separating plates 38 are located on another side of the gas outlet 224 opposite to the side where the first separating plates 36 are located. Each of the first separating plates 36 has a first groove 362, while each of the second separating plates 38 has a second groove 382.

The stop plates 40 are made of a transparent material, which is tempered glass in the current embodiment. Each of the stop plates 40 is long, and a major axial direction thereof is parallel to the major axial direction of the combustor 20. The stop plates 40 pass through the opening 286 of the separator 28, wherein one of the stop plate 40 is vertically inserted into the first grooves 362, while the other one of the stop plate 40 is vertically inserted into the second grooves 382, so that the stop plates 40 face each other, with the gas outlet 224 located therebetween. Each of the stop plates 40 has a top edge 402, wherein each of the top edges 402 is higher than the top surface of the separator 28. Whereby, a first air inlet 364 is formed between each two adjacent first separating plates 36 under the separator 28, while a second air inlet 384 is formed between each two adjacent second separating plates 38. The first air inlets 364 and the second air inlets 384 respectively communicate with a space between the stop plates 40. In practice, two stop plates could also be connected to peripheral edges of the opening 286 of the separator 28.

Furthermore, two bent plates 42 are provided on the two sides of the gas outlet 224, wherein the bent plates 42 are arranged in the reference axial direction D, and are respectively located between the gas outlet 224 and one of the stop plates 40. A distance between each of the bent plates 42 and the corresponding stop plate 40 gradually decreases from bottom to top. Each of the bent plates 42 has a plurality of perforations 422, which are arranged in the reference axial direction D, and are lower than the gas outlet 224.

Figure 6:
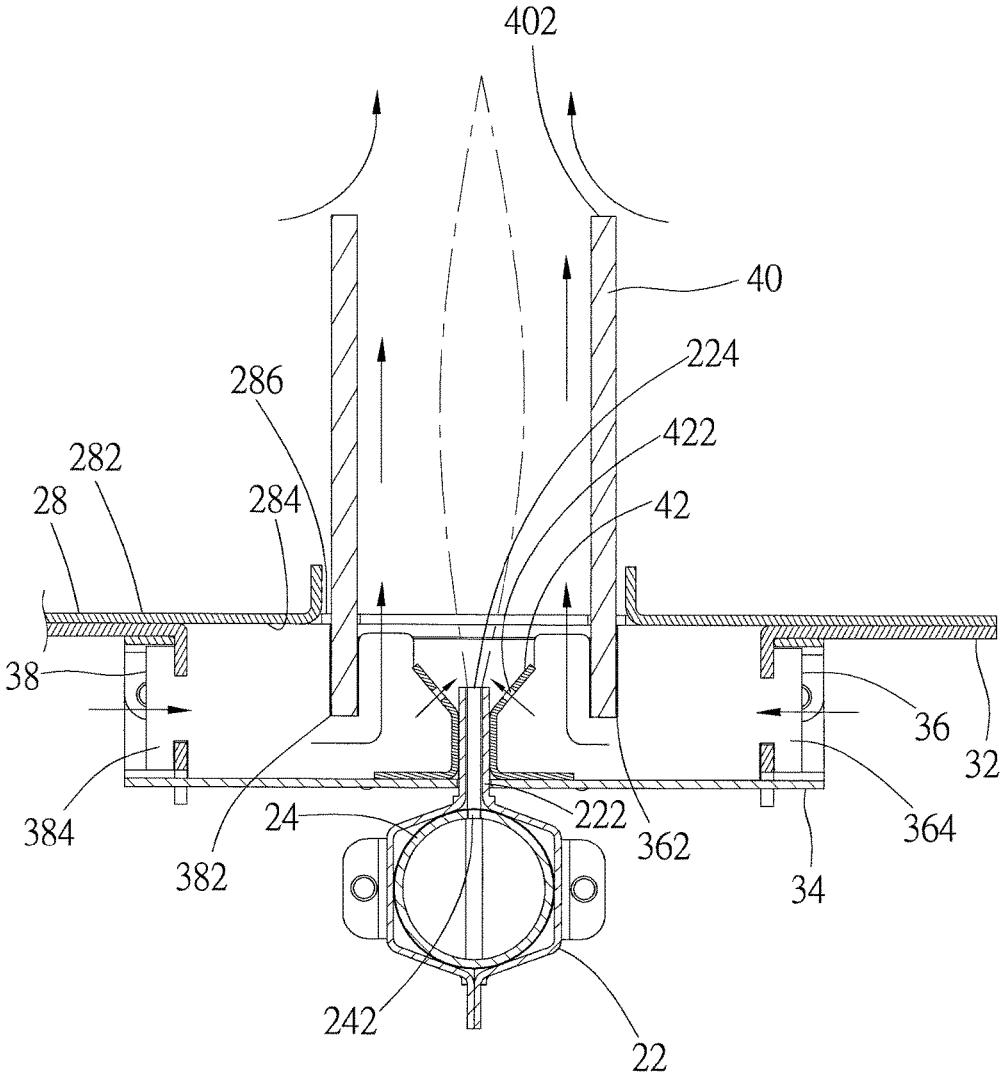
FIG. 6 is a sectional view of the gas-burning appliance of the embodiment of the present invention.
Figure 7:
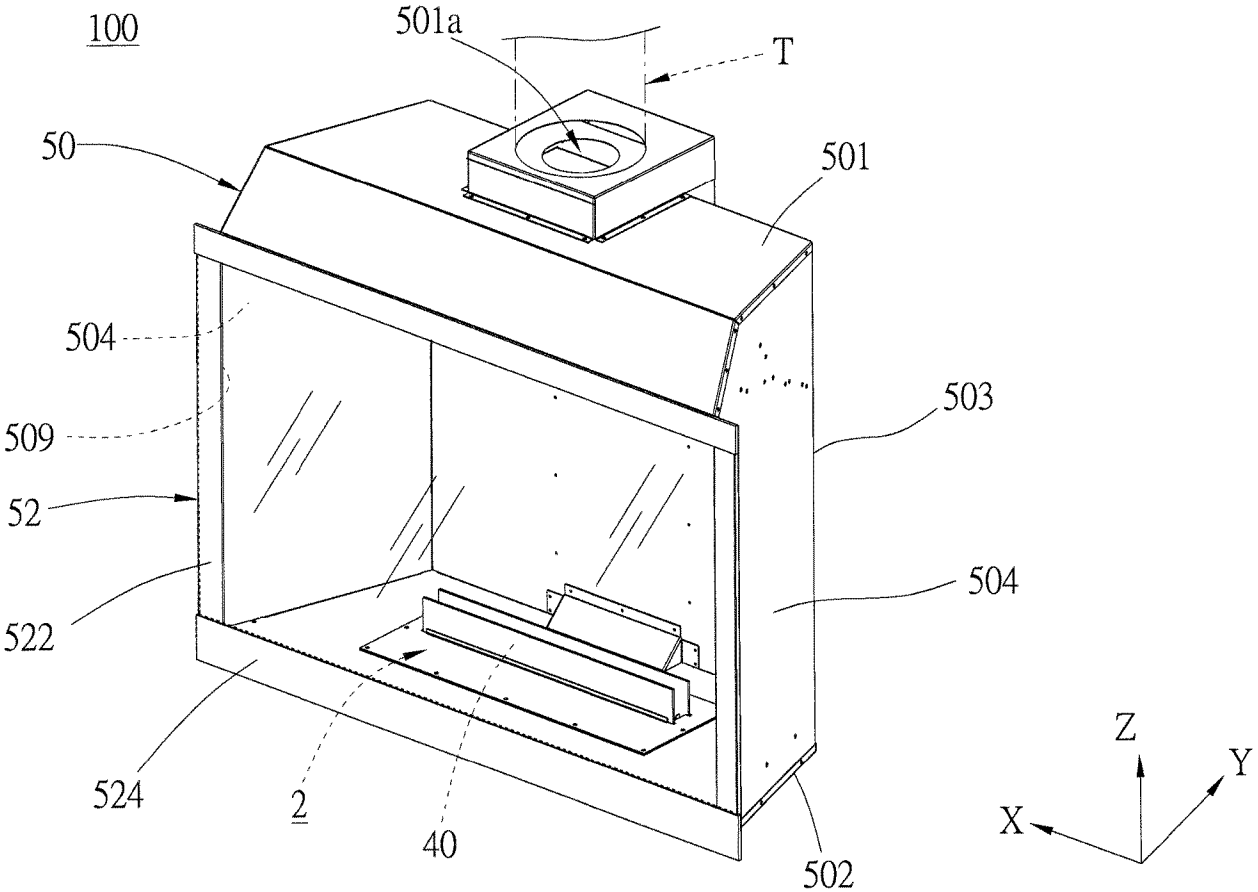
FIG. 7 is a perspective view of the gas fireplace of the embodiment of the present invention.
Figure 8:
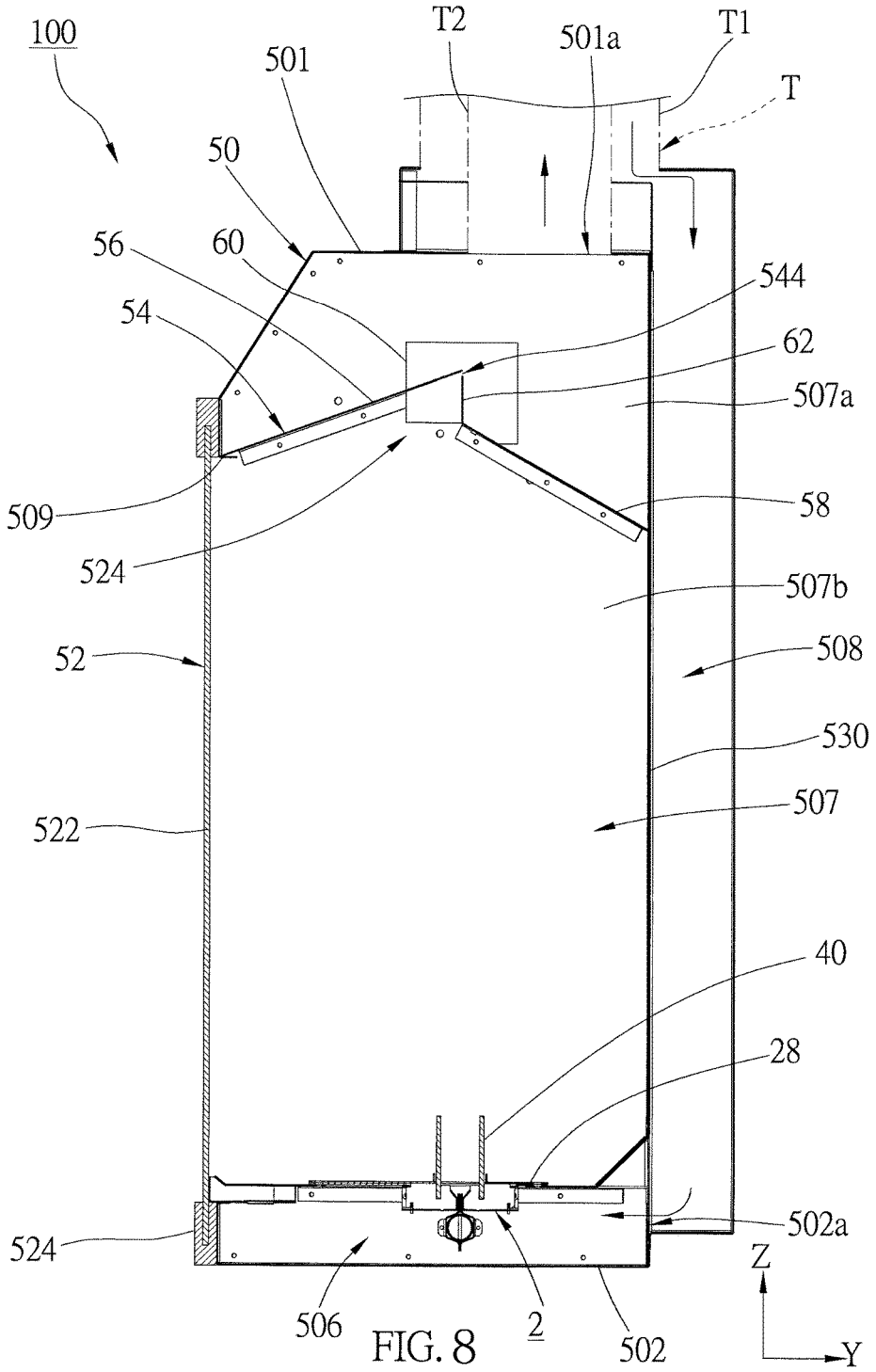
FIG. 8 is a sectional view of the gas fireplace of the embodiment of the present invention.
Figure 9:
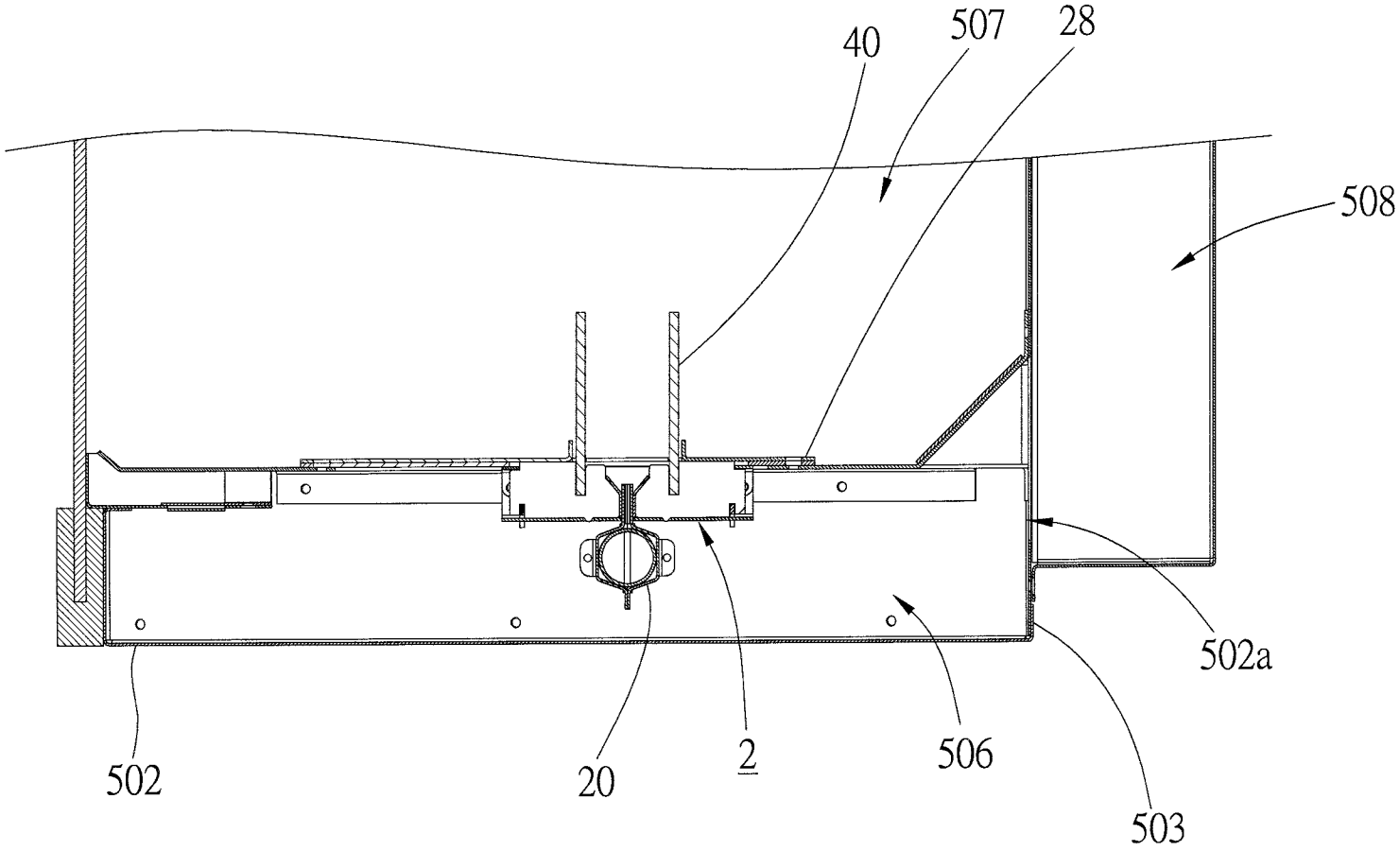
FIG. 9 is an enlarged partial view of FIG. 8.
Figure 10:
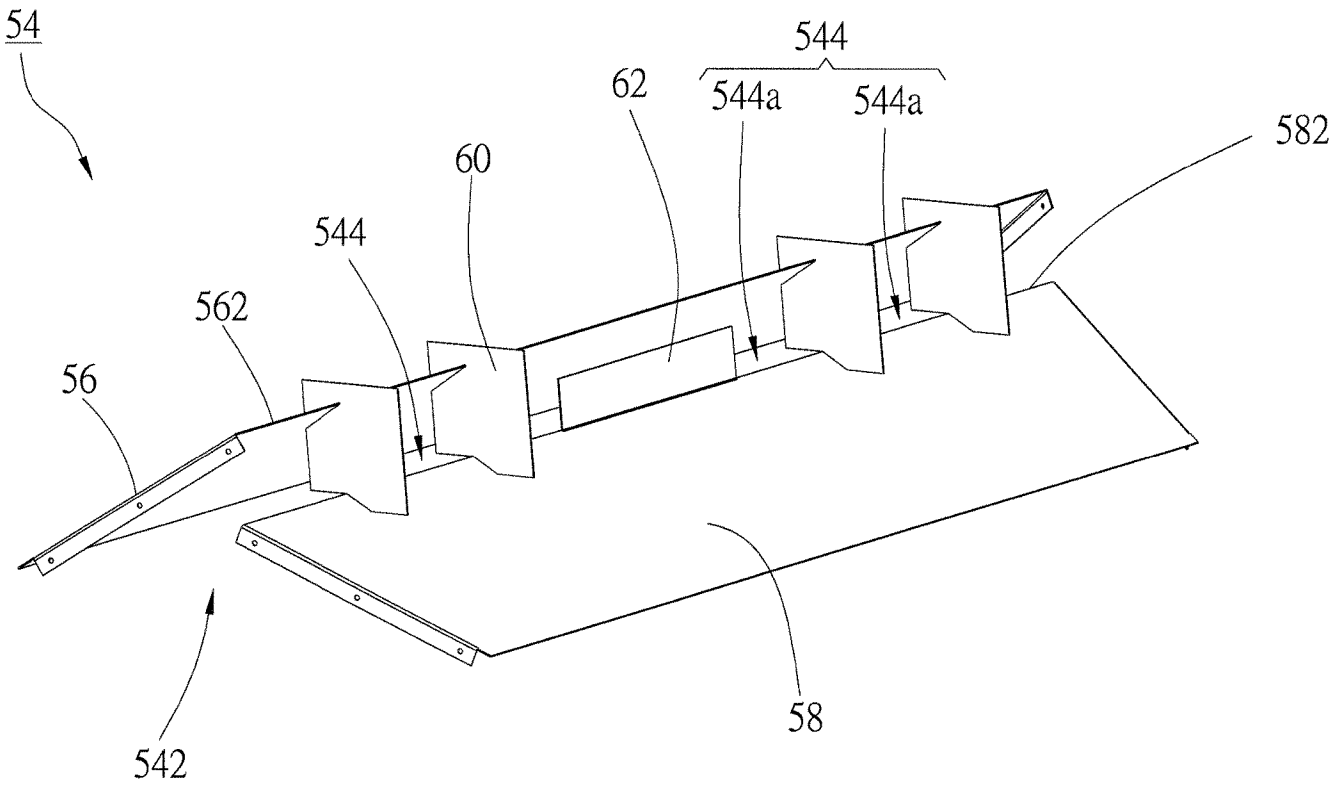
FIG. 10 is a perspective view of the auxiliary exhaust device of the embodiment of the present invention.

As shown in FIG. 6, the primary gas-mixing for gas and air takes place in the tube 24 of the combustor 20; after that, the mixed gas leaves through the gas outlet 224 and starts to burn. During the combustion, the flame heats up the surrounding air, which then rises to create a stack effect in the semi-closed space between the stop plates 40, leading to a negative pressure at the top edges of the stop plates 40. Due to the negative pressure, air would be continuously drawn to the location near the gas outlet 224 through the first air inlets 364 and the second air inlets 384 below the separator 28, wherein part of the air would be guided to the space between the bent plates 42 through the perforations 422 to be mixed with gas to facilitate the combustion. The perforations 422 are lower than the gas outlet 224, which prevents the air passing through the perforations 422 from pushing down the gas out from the gas outlet 224, and therefore the height of the flame would not be affected.

Another part of the air is mixed with gas at the location higher than the bent plates 42, and the mixed gas is guided toward the stop plates 40 in a nearly linear way. Due to Coandă effect, the guided airflow would stay attached to a surface of each of the stop plates 40, instead of blowing into the flame directly. After the guided airflow is heated, and with the Coandă effect, a secondary air could stay attached to the stop plates 40 for a longer distance, which helps to maintain the steadily uprising trend of the flow field. As a result, a scope of laminar flow for the flame would be greatly expanded, which would reduce the possibility of having turbulence.

The Coandă effect is the tendency of a fluid jet to stay attached to a convex surface, for the viscosity of fluid creates friction between the fluid and the surface of the object that it is flowing through, which slows down the flow speed of the airflow near the surface of the object. As long as the surface of the object does not excessively change in curvature, the decelerated flow speed would make the guided air attach to the surface of the object while flowing. However, once the pressure gradient on the surface of the object turns zero or negative, the fluid would no longer be attached to the surface of the object, and would create eddies while leaving the surface.

Whereby, the original flame would be steadily and evenly extended with the guiding of air curtain. On the same scale of combustion, the visibility of the flame would be greatly increased when observed from the front. On the other hand, when observed from lateral, the flame would be flat as being compressed by the air curtain. The stop plates 40 are not required to be high to provide such effect.

Since the first and the second air inlets 364, 384 are located below the separator, the airflow above the separator 28 would not be affected, and therefore the airflow above the separator 28 could steadily flow upward. The flame would be clearly visible through the transparent stop plates 40. Furthermore, since the fresh air below the separator 28 could be directly directed to the combustion space between the stop plates 40 without being mixed with the high-temperature waste gas, air with high oxygen concentration could be gathered and effectively guided to the combustion space. Whereby, the combustion efficiency would be greatly improved.

In addition, the passage formed by the first separating plates 36 and the second separating plates 38 of the gas-burning appliance 2 has multiple turns, which would effectively reduce the disturbance caused by the intake air in the combustion region, and evenly control the air intake to effectively prevent backfire. At the same time, the heat dissipation ability of the gas-burning appliance 2 would be also enhanced to lower the temperature of the gas-burning appliance 2, which improves the safety.

In comparison to the conventional gas-burning appliance 1, the gas-burning appliance 2 provided in the present invention could increase the height of the flame without increasing the amount of gas supply, which also saves gas. In addition, since the airflow flows upward in a state of laminar flow, the shape of the flame could be maintained stable, and the heat generated by the flame could be guided upward, reducing the heat energy accumulated around the gas-burning appliance 2. In practice, if the height of the flame is not specifically required, the bent plates 42 could be omitted. The height of the flame would be still higher than that of the flame created in the conventional gas-burning appliance 1.

A gas fireplace 100 of the current embodiment is illustrated in FIG. 7 to FIG. 12, wherein the gas fireplace 100 includes the aforementioned gas-burning appliance 2, and further includes a firebox 50, a translucent shield 52, and an auxiliary exhaust device 54. To make the following explanation more understandable, the firebox 50 is defined to have a first axial direction X, a second axial direction Y, and third axial direction Z in a three-dimensional coordinate system, wherein the first axial direction X and the second axial direction Y are different directions on a horizontal plane with an included angle formed therebetween, while the third axial direction Z points upward in a vertical direction. In the third axial direction Z, the firebox 50 has a top portion 501 and a bottom portion 502 opposite to the top portion 501, wherein an exhaust port 501*a* is provided on the top portion 501, and an intake port 502*a* is provided either on the bottom portion 502 or another location on the firebox 50 near the bottom portion 502. Forward directions of the intake port 502*a* and the exhaust port 501*a* could be either the same or different. In the current embodiment, the forward direction of the intake port 502*a* is in the second axial direction Y, while the forward direction of the exhaust port 501*a* is in the third axial direction Z. However, these are not limitations of the present invention.

The firebox 50 further includes a rear plate 503 and two opposite lateral plates 504, which are respectively provided between the top portion 501 and the bottom portion 502. The lateral plates 504 are, respectively, provided at two opposite sides of the rear plate 503 in the first axial direction X to form an internal space 505 of the firebox 50 along with the rear plate 503. An intake passage 508 is further provided at a side of the rear plate 503 away from the internal space 505 (i.e., a rear side of the firebox 50), wherein an end of the intake passage 508 communicates with the intake port 502*a*, while another end thereof communicates an outer pipe T1 of an air pipeline T. An inner pipe T2 of the air pipeline T communicates with the exhaust port 501*a*. A window 509 is provided on a side of the firebox 50 opposite to the rear plate 503 (i.e., a front side of the firebox 50), wherein the window 509 is located between the intake port 502*a* and the exhaust port 501*a*, and communicates with the internal space 505.

The translucent shield 52 is provided on the side of firebox 50 provided with the window 509, and covers the window 509. The translucent shield 52 includes a main body 522 and an outer frame 524, wherein the outer frame 524 is provided on an outer edge of the main body 522, and is engaged with a surrounding of the firebox 50 near the window 509, so that the main body 522 either exactly covers the window 509 or at least covers a side of the window 509 near the bottom portion 502. The flame burning in the firebox 50 could be visible through the main body 522. Therefore, the main body 522 is mainly made of a high-temperature resistant and translucent material, such as glass or crystal. In other embodiments, the translucent shield 52 is not necessary to be completely made of a translucent material, but could be a metal plate with a hollow structure embedded with translucent materials.

The gas-burning appliance 2 is provided in the firebox 50 near the bottom portion 502, wherein the separator 28 is connected to an inner wall of the firebox 50 in the first axial direction X and the second axial direction Y, which divides the internal space 505 into an air chamber 506 below the separator 28 and a combustion chamber 507 above the separator 28. The air chamber 506 and the combustion chamber 507 communicate with each other through the opening 286 of the separator 28. The air chamber 506 communicates with the intake port 502*a*; the combustion chamber 507 corresponds to the main body 522 of the translucent shield 52, and communicates with the exhaust port 501*a*. Since the stop plates 40 of the gas-burning appliance 2 could guide airflow and maintains the steadier uprising trend of the flow field, the turbulence happened in the lower half of the combustion chamber 507 could be significantly reduced. As a result, the upper portion of the firebox 50 could have a higher temperature, which increases the temperature difference in the firebox 50. If the thermal efficiency is required to be further improved, a heat sink could be installed at the location which has the highest temperature in the firebox 50 to facilitate thermal efficiency.

The auxiliary exhaust device 54 is provided on a wall of the combustion chamber 507 of the firebox 50, and divides the combustion chamber 507 into a first space 507*a* and a second space 507*b*, wherein the first space 507*a* is between the auxiliary exhaust device 54 and the exhaust port 501*a* of the firebox 50, and communicates with the exhaust port 501*a*, while the second space 507*b* is between the auxiliary exhaust device 54 and the separator 28, and corresponds to the main body 522 of the translucent shield 52. The auxiliary exhaust device 70 has an exhaust passage 542, which communicates the first space 507*a* and the second space 507*b*. Furthermore, a width of the exhaust passage 542 gradually narrows from the second space 507*b* toward the first space 507*a*, and an exit 544 is provided on a side opposite to the exhaust port 501*a*.

In the current embodiment, the auxiliary exhaust device 54 has a first guide plate 56 and a second guide plate 58, which are inclined to each other. An end of the first guide plate 56 and an end of the second guide plate 58 are, respectively, connected to one of two opposite walls in the combustion chamber 507, while another ends thereof are, respectively, inclined to each other and toward the exhaust port 501*a*, with a certain distance left therebetween, forming the exhaust passage 542 between the first guide plate 56 and the second guide plate 58 which has the width gradually decreased from the second space 507*b* toward the first space 507*a*. The end of the first guide plate 56 which is inclined toward the exhaust port 501*a* has a first top edge 562, while the end of the second guide plate 58 which is inclined toward the exhaust port 501*a* has a second top edge 582, wherein the first top edge 562 is parallel to the second top edge 582, and the first top edge 562 is higher than the second top edge 582 in a vertical direction. The exit 544 of the exhaust passage 542 is formed between the first top edge 562 and the second top edge 582, wherein a major axial direction of the exit 544 extends in the first axial direction X of the firebox 50, and a length of extension is greater than or equal to a length of the gas outlet 224 of the combustor 20. Preferably, the exit 544 is located above the gas outlet 224.

With the aforementioned structure, the waste gas of combustion generated by burning gas would form a hot airflow in the second space 507*b* of the combustion chamber 507, wherein the hot airflow would flow from the second space 507*b* toward the first space 507*a*. Once the hot airflow contacts with the first guide plate 56 and the second guide plate 58 of the auxiliary exhaust device 54, its flow direction would be changed due to the block of the first guide plate 56 and the second guide plate 58, and the hot airflow would then flows into the first space 507*a* through the exit 544 of the exhaust passage 542. During this process, since the width of the exhaust passage 542 gets narrower from the second space 507*b* toward the first space 507*a*, the flow speed of the hot airflow would be increased at locations near the exit 544 of the exhaust passage 542 to generate a low-pressure suction, which would help to draw the waste gas of combustion in the second space 507*b* into the first space 507*a*.

After the hot airflow passing through the exit 544 of the exhaust passage 542, its flow speed is decelerated to be less than or approaching the amount of fluid exhaust of the inner pipe T2 of the air pipeline T, therefore, the waste gas of combustion flowing into the first space 507*a* could be more easily exhausted outside from the exhaust port 501*a* through the inner pipe T2 of the air pipeline T. In this way, the waste gas of combustion would be prevented from staying in the first space 507*a*. Furthermore, with the inclined arrangements of the first guide plate 56 and the second guide plate 58, and the structural features of the design that the width of the exhaust passage 542 is gradually decreased from the second space 507*b* toward the first space 507*a*, the hot airflow in the first space 507*a* which contacts with the top portion of the firebox 50 would be prevented from flowing downward and back into the second space 507*b*, which would help to reduce the accumulation of the waste gas of combustion in the firebox 50.

The auxiliary exhaust device 54 could help the waste gas of combustion to enter the first space 507*a* more smoothly, which could reduce the possibility of creating turbulence in the second space 507*b* by the hot airflow. Also, the auxiliary exhaust device 54 could also prevent the problem of excessively high temperature which might happen if the waste gas of combustion stays in the second space 507*b*.

Figure 11:
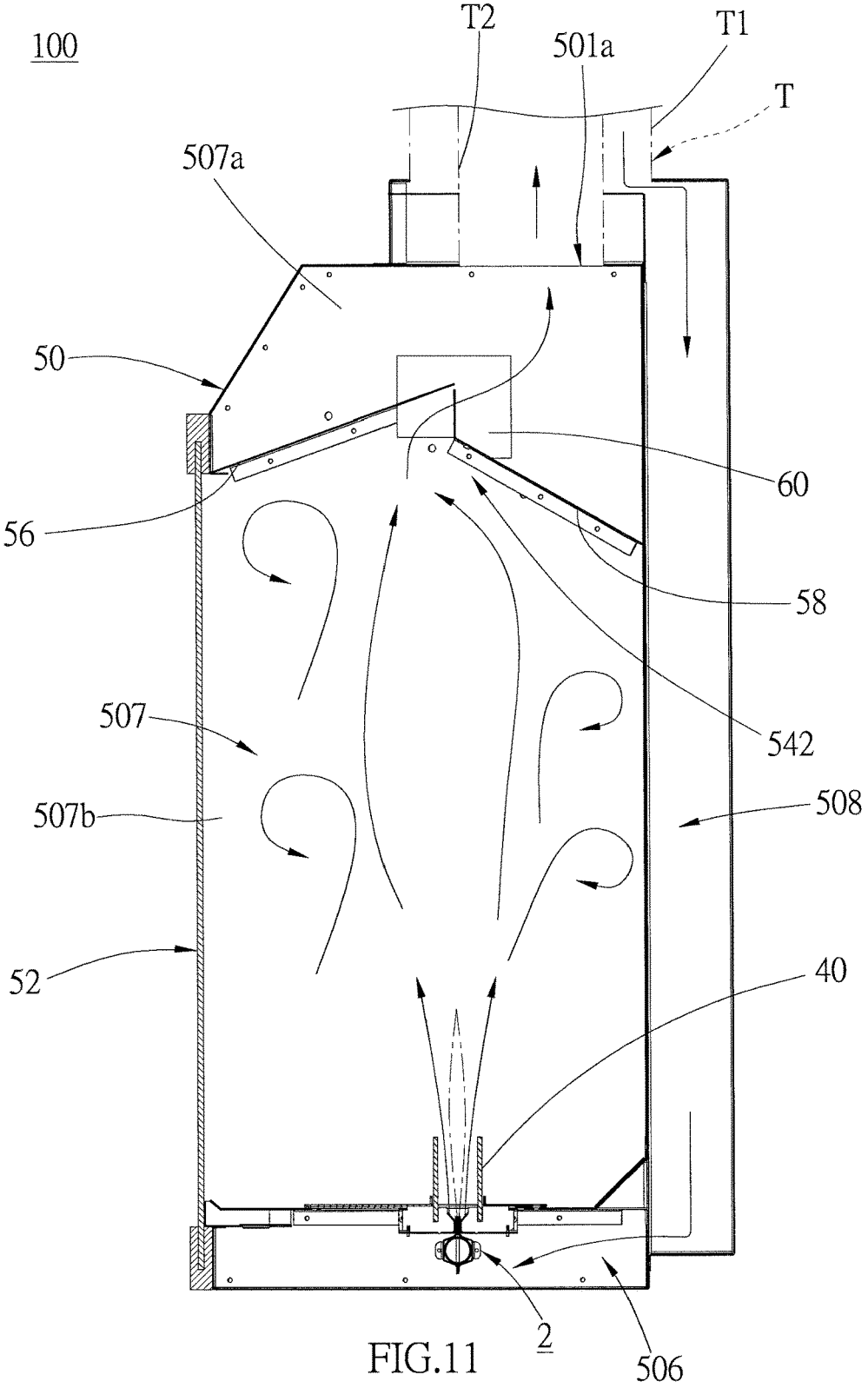
FIG. 11 is a schematic view, showing the airflow of the fireplace of the embodiment of the present invention.
Figure 12:
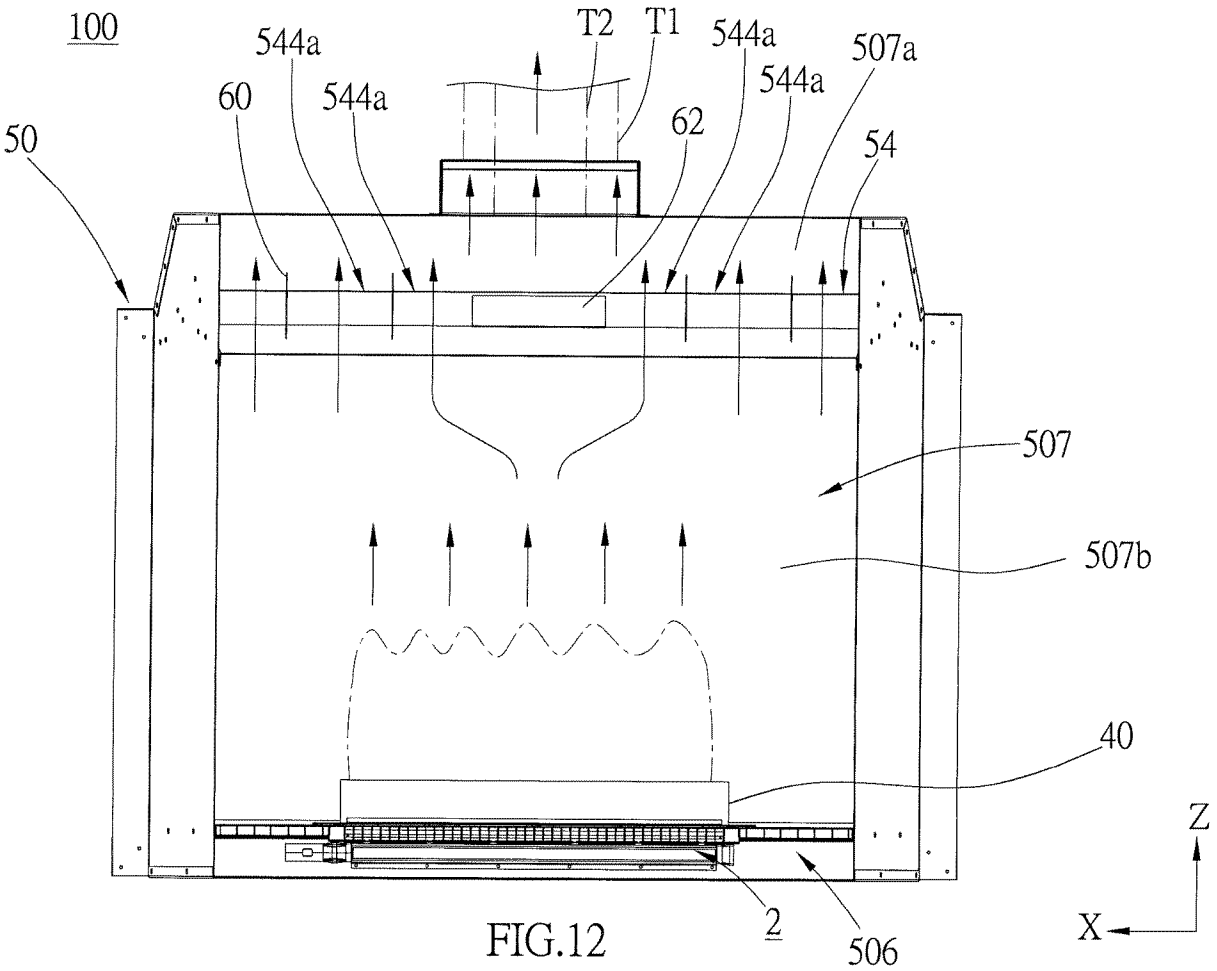
FIG. 12 is a schematic view, showing the airflow of the fireplace of the embodiment of the present invention.

As shown in FIG. 11 and FIG. 12, in order to prevent the hot airflow from gathering at some locations in the exhaust passage 542 while the hot airflow is flowing toward the exhaust port 501*a*, one or multiple splitter plates 60 could be optionally provided on the auxiliary exhaust device 54 to divide the exit 544 of the exhaust passage 542 into several sub-exits 544*a*, whereby the hot airflow could flow into the first space 507*a* through each of the sub-exits 544*a*. In the current embodiment, the auxiliary exhaust device 54 includes four splitter plates 60, or at least two splitter plate 60*s*. However, the number of the splitter plates 60 is not a limitation of the present invention. The splitter plates 60 are vertically engaged with the first top edge 562 of the first guide plate 56, wherein an end of each of the splitter plates 60 abuts against the second top edge 582 of the second guide plate 58. The splitter plates 60 are arranged separately to divide the exit 544 of the exhaust passage 542 into multiple sub-exits 544*a*.

In practice, the splitter plates 60 could be provided between the first guide plate 56 and the second guide plate 58 in an either vertical or inclined way. Alternatively, two adjacent splitter plates 60 could be inclined to each other toward the exhaust port 501*a* of the firebox 50, which makes a distance between said two adjacent splitter plates 60 gradually reduced from the second top edge 582 toward the first top edge 562. In this way, the hot airflow could be guided by said two adjacent splitter plates 60 to flow into the first space 507*a* through the corresponding sub-exit 544*a* more quickly. Whereby, the possibility of creating turbulence in the second space 507*b* by the hot airflow could be further reduced.

In order to further spread the hot airflow, a spoiler 62 could be further provided between two of the splitter plates 60 in a way that the spoiler 62 corresponds to one of the sub-exits 544*a*. Preferably, the spoiler 62 is provided between two of the splitter plates 60 which are near a middle location among the multiple splitter plates 60. The spoiler 62 is located below the exhaust port 501*a*, and is engaged with the second top edge 582 of the second guide plate 58 in the first axial direction X. The spoiler 62 is parallel to the second top edge 582. An end of the spoiler 62 is connected to the second top edge 582, while another end thereof extends toward the first top edge 562 of the first guide plate 56 to partially cover the corresponding sub-exit 544*a*, which reduces the width of the corresponding sub-exit 544*a*.

In this way, when the hot airflow flows to the sub-exit 544*a* corresponding to the spoiler 62, its flow speed would suddenly drop due to the block of the spoiler 62 and the reduced width of said sub-exit 544*a*, and the hot airflow would flow toward the two opposite ends of the spoiler 62 and, eventually, into other sub-exits 544*a*. In this way, the hot airflow could be further spread, and the chances of having turbulence would be reduced. Furthermore, the waste gas of combustion could be also prevented from accumulating heat energy in the combustion chamber 507, which would effectively lower the temperature of the translucent shield 52.

The main differences between the present invention and the prior art include: (1) the secondary air mixing for combustion is precisely controlled through the flow guide design, whereby, while burning gas, the oxygen concentration of the intake air would not be significantly reduced by the disturbance of the high-temperature waste gas above the separator, which would improve the combustion efficiency; (2) by using the Coandă effect of fluid, the combustion space for flame of laminar flow would be effectively extended, and the turbulence which may be created around the flame would be significantly reduced, which prevents excessive air-mixing that may generate colorless flame and nitride. In summary, the gas-burning appliance disclosed in the present invention could provide greater compatibility and high performance, and exhaust small amount of carbon monoxide and nitride. Furthermore, the visibility and height of visible yellow-orange flame could be increased without increasing the amount of gas supply. The gas-burning appliance could be used in a gas fireplace, as exemplified above. However, the use of the gas-burning appliance would not be merely limited as described in the present invention.

It must be pointed out that the embodiments described above are only some embodiments of the present invention. All equivalent structures which employ the concepts disclosed in this specification and the appended claims should fall within the scope of the present invention.

What is claimed is:

1. A gas-burning appliance, comprising:

a combustor adapted to burn gas, wherein the combustor is long, and has a gas outlet provided in a major axial direction thereof; and a flow guide device engaged with the combustor, wherein the flow guide device includes a laterally provided separator and two stop plates facing each other; the separator has a long opening; each of the stop plates is long, and is located at the opening, wherein a top edge of each of the stop plates is higher than a top surface of the separator; the combustor is located below the separator, with the gas outlet corresponding to a space between the stop plates; the flow guide device further has at least one first air inlet located below the separator, wherein the at least one first air inlet communicates with the space between the stop plates; and wherein the at least one first air inlet of the flow guide device comprises a plurality of first air inlets; the flow guide device comprises a plurality of first separating plates located below the separator, wherein the first separating plates are separately arranged in a reference axial direction, which is parallel to the major axial direction of the combustor; the first separating plates are located on a side of the gas outlet; each of the first air inlets is formed between two adjacent first separating plates among the plurality of first separating plates.

2. The gas-burning appliance of claim 1, wherein the flow guide device comprises a plurality of second separating plates located below the separator, wherein the second separating plates are separately arranged in the reference axial direction, and are on another side of the gas outlet opposite to the first separating plates; a second air inlet is formed between two adjacent second separating plates among the plurality of second separating plates.

3. The gas-burning appliance of claim 2, wherein each of the first separating plates has a first groove, while each of the second separating plates has a second groove; the stop plates pass through the opening, wherein one of the stop plates is inserted into the first grooves, while the other one of the stop plates is inserted into the second grooves.

4. The gas-burning appliance of claim 2, wherein the flow guide device comprises two bent plates, each of which is provided in the reference axial direction, and is located between the gas outlet and one of the stop plates; a distance between each of the bent plates and the corresponding stop plate gradually reduces from bottom to top.

5. The gas-burning appliance of claim 4, wherein each of the bent plates has a plurality of perforations, which are provided in the reference axial direction.

6. The gas-burning appliance of claim 5, wherein the perforations are lower than the gas outlet.

7. The gas-burning appliance of claim 2, wherein the flow guide device comprises a holder located below the separator; the first separating plates and the second separating plates are provided on the holder.

8. The gas-burning appliance of claim 1, wherein the stop plates are made of a transparent material.

9. The gas-burning appliance of claim 1, wherein the combustor comprises an outer casing and a tube; the outer casing has two protruding plates, wherein the gas outlet is formed between the protruding plates; the tube is provided in the outer casing, and has a plurality of exhaust orifices adapted for gas to pass therethrough; the exhaust orifices are provided in the major axial direction, and correspond to the gas outlet.

10. A fireplace, comprising:

a firebox comprising an intake port, an exhaust port, and a window, wherein the window is located between the intake port and the exhaust port;

a translucent shield covering the window;

a flow guide device provided in the firebox, wherein the flow guide device comprises a separator and two stop plates facing each other; the separator divides the firebox into an air chamber below and a combustion chamber above, wherein the air chamber communicates with the intake port, while a front side of the combustion chamber corresponds to the translucent shield, and communicates with the exhaust port; the separator has a long opening communicating the air chamber and the combustion chamber; each of the stop plates is long, and is located at the opening, wherein a top edge of each of the stop plates is higher than a top surface of the separator; the flow guide device further has at least one first air inlet located below the separator, wherein the at least one first air inlet communicates with the opening; and a combustor adapted to burn gas, wherein the combustor is long, and has a gas outlet provided in a major axial direction thereof; the combustor is located below the separator; the gas outlet corresponds to a space between the stop plates; and wherein the flow guide device further has a plurality of first air inlets located below the separator, and each of the plurality of first air inlets is formed between two adjacent first separating plates among the plurality of first separating plates and communicates with the opening.

11. The fireplace of claim 10, wherein the flow guide device comprises a plurality of second separating plates located below the separator, wherein the second separating plates are separately arranged in the reference axial direction, and are on another side of the gas outlet opposite to the first separating plates; a second air inlet is formed between two adjacent second separating plates among the plurality of second separating plates.

12. The fireplace of claim 11, wherein each of the first separating plates has a first groove, while each of the second separating plates has a second groove; the stop plates pass through the opening, wherein one of the stop plates is inserted into the first grooves, while the other one of the stop plates is inserted into the second grooves.

13. The fireplace of claim 11, wherein the flow guide device comprises two bent plates, each of which is provided in the reference axial direction, and is located between the gas outlet and one of the stop plates; a distance between each of the bent plates and the corresponding stop plate gradually reduces from bottom to top.

14. The fireplace of claim 13, wherein each of the bent plates has a plurality of perforations, which are provided in the reference axial direction.

15. The fireplace of claim 14, wherein the perforations are lower than the gas outlet.

16. The fireplace of claim 11, wherein the flow guide device comprises a holder located below the separator; the first separating plates and the second separating plates are provided on the holder.

17. The fireplace of claim 10, wherein the stop plates are made of a transparent material.

18. The fireplace of claim 10, wherein the combustor comprises an outer casing and a tube; the outer casing has two protruding plates, wherein the gas outlet is formed between the protruding plates; the tube is provided in the outer casing, and has a plurality of exhaust orifices adapted for gas to pass therethrough; the exhaust orifices are provided in the major axial direction, and correspond to the gas outlet.

19. The fireplace of claim 10, further comprising an auxiliary exhaust device provided in the combustion chamber, wherein the auxiliary exhaust device divides the combustion chamber into a first space and a second space; the auxiliary exhaust device has an exhaust passage communicating the first space and the second space, wherein a width of the exhaust passage gradually reduces from the second space toward the first space.

20. The fireplace of claim 19, wherein the auxiliary exhaust device comprises a first guide plate and a second guide plate, wherein an end of the first guide plate and an end of the second guide plate are respectively connected to two opposite walls of the combustion chamber, while another ends thereof are respectively inclined to each other toward the exhaust port, with a certain distance left therebetween, forming the exhaust passage between the first guide plate and the second guide plate.

21. The fireplace of claim 20, wherein the end of the first guide plate inclined toward the exhaust port has a first top edge, while the end of the second guide plate inclined toward the exhaust port has a second top edge; the first top edge is higher than the second top edge in a vertical direction; an exit of the exhaust passage is formed between the first top edge and the second top edge.

22. The fireplace of claim 21, wherein the auxiliary exhaust device comprises two splitter plates, which are engaged with the first top edge in an axial direction of the exhaust port, and abut against the second top edge; the splitter plates are separately arranged to divide the exit into multiple sub-exits.

23. The fireplace of claim 22, wherein the auxiliary exhaust device comprises a spoiler provided between the splitter plates; the spoiler is engaged with the second top edge in the axial direction of the exhaust port, and partially covers the sub-exit between the splitter plates.

* * * * *